US005140379A

United States Patent [19]

Johnson

[11] Patent Number: 5,140,379

[45] Date of Patent: Aug. 18, 1992

[54] POSITION CONTROL APPARATUS FOR TRANSFER DRUM IN ELECTROSTATOGRAPHIC PRINTER/COPIER

[75] Inventor: Kevin M. Johnson, Rochester, N.Y.

[73] Assignee: Eastman Kodak Company, Rochester, N.Y.

[21] Appl. No.: 688,004

[22] Filed: Apr. 19, 1991

[51] Int. Cl.[5] ..... G03G 21/00

[52] U.S. Cl. ..... 355/317; 74/384; 74/395; 355/272; 355/277; 355/279; 355/327

[58] Field of Search ..... 355/272, 274, 277, 279, 355/271, 317, 326, 327; 74/384, 395; 346/160, 157

[56] References Cited

U.S. PATENT DOCUMENTS

| | | | |
|---|---|---|---|
| 3,390,632 | 7/1968 | Jähme | 74/395 |
| 3,516,297 | 10/1968 | Dullinger | 74/395 |
| 3,947,113 | 3/1976 | Buchan et al. | 355/271 |
| 4,541,709 | 9/1985 | Kampschreur | 355/277 |
| 4,605,298 | 8/1986 | Russel et al. | 355/271 |
| 4,705,386 | 11/1987 | Ogita et al. | 355/317 X |
| 4,872,037 | 10/1989 | Kasahara et al. | 355/271 |
| 4,947,209 | 8/1990 | Maeno et al. | 355/208 X |
| 4,994,827 | 2/1991 | Jamzadeh et al. | 355/326 X |
| 5,021,829 | 6/1991 | Johnson | 355/271 X |
| 5,021,835 | 6/1991 | Johnson | 355/271 |

*Primary Examiner*—A. T. Grimley
*Assistant Examiner*—Robert Beatty
*Attorney, Agent, or Firm*—Warren W. Kurz

[57] ABSTRACT

In an electrostatographic printer and/or copier, toner images are transferred from the outer surface of a rotating image process drum to a receiver sheet carried on the outer surface of a rotating transfer drum as the respective drum surfaces pass through a transfer zone defined by a nip between the drums. To assure precise registration of the transferred toner image with a desired portion of the receiver sheet a planetary positional control apparatus is provided for adjusting the angular position of the transfer drum relative to that of the process drum as the transfer drum rotates to present the receiver sheet to the image transfer zone. Such apparatus responds to a control signal representing variations, from nominal, in the position of the toner image on the process drum and/or in the position of the receiver sheet on the transfer drum. The planetary positional control apparatus of the invention is particularly useful in color electrostatographic systems for precisely registering multiple color separation images on a receiver sheet.

15 Claims, 3 Drawing Sheets

POSITION CONTROL APPARATUS FOR TRANSFER DRUM IN ELECTROSTATOGRAPHIC PRINTER/COPIER

TECHNICAL FIELD OF THE INVENTION

The present invention relates to improvements in apparatus for transferring toner images from a rotating image process drum to a precise location on the surface of a rotating transfer drum. The invention is particularly useful in the field of color electrostatography, including electrophotography and electrography, for precisely registering transferable toner images on an image receiver sheet to produce a full color image thereon.

BACKGROUND ART

In the electrostatographic process of producing full color images on an image receiver sheet (e.g., a sheet of plain paper), a plurality of toner images of different color (e.g., cyan, magenta, yellow and black) are produced on a reusable dielectric (usually photoconductive) recording element. Such images are then transferred to the receiver sheet, one atop the other and in registration, to produce the desired full color image. As may be readily appreciated, image quality is determined, to a large extent, by the degree to which the transferred images are in registration on the receiver sheet. In electrophotographic systems in which the transferable images are formed on a continuously moving recording element, precise registration requires that each transferable image arrive at an image transfer zone at the precise instant that the desired portion of the receiver sheet to which the image is to be transferred arrives. Precise registration is no trivial problem, especially when attempting to produce full color images of photographic quality from a series of transferable toner images.

In the commonly assigned U.S. application Ser. No. 488,546, now U.S. Pat. No. 5,040,026 filed on Mar. 5, 1990 in the names of F. S. Jamzadeh et al., entitled MULTICOLOR IMAGE FORMING APPARATUS, there is disclosed an electrophotographic apparatus in which transferable toner images of different colors are formed on the outer surface of a photoconductive drum. These images are transferred, one at a time, to a receiver sheet to provide a full color image thereon. Such apparatus comprises a rotatably mounted transfer drum which is adapted to support and transport the receiver sheet on a portion of its outer surface. The transfer drum is spring biased toward the photoconductive drum so that the respective outer surfaces of the drums are in physical contact. The photoconductive drum is rotatably driven and, when a receiver sheet is positioned in the nip between the drums to effect image transfer, the photoconductive drum frictionally drives the transfer drum through the receiver sheet. According to a preferred embodiment, a caming mechanism serves to separate the drums between successive image transfers and, during this interframe period, and independent stepper motor serves to rotatably drive the transfer drum to re-index the transfer drum with the photoconductive drum. An encoding system is provided to monitor the relative positions of the drums so that the stepper motor can, at the appropriate time, accelerate the transfer drum to the same speed as the photoconductive drum and present the receiver sheet to the transfer nip in timed relation with the arrival of the transferable image on the photoconductive drum.

In comparison to systems employing two independent stepper motors to continuously rotate the process and transfer drums during image transfer, the above technique of using the photoconductive drum to drive the transfer drum during image transfer and of re-indexing the transfer drum after each image transfer is highly advantageous in the degree of registration it provides. Such image transfer apparatus is capable of achieving image registration accuracy of better than 0.0025 cm. over the entire image area. As noted above, however, the preferred apparatus disclosed in this application uses two separate precision drive motors, one to continuously drive the photoconductive drum, and the other to accelerate and control the velocity of the transfer drum to achieve re-indexing during the interframe period.

In the commonly assigned U.S. application Ser. No. 532,831 now U.S. Pat. No. 5,021,835 filed on Jun. 4, 1990 in the name of K. M. Johnson, entitled MULTICOLOR IMAGING APPARATUS WITH IMPROVED TRANSFER MEANS, there is disclosed an electrophotographic recording apparatus having a transfer mechanism somewhat similar to that described above. In this apparatus, however, the two drums (i.e., the photoconductive image process drum and transfer drum) are physically separated by a distance less than the compacted thickness of the receiver sheet. As in the above-described system, the photoconductive drum drives the transfer drum through the receiver sheet during image transfer. Also, the preferred apparatus disclosed uses two precision drive motors, one for each drum.

In the commonly assigned U.S. application Ser. No. 685,251, filed on Apr. 15, 1991 in the name of Kevin M. Johnson and entitled OVERRIDABLE WORM GEAR DRIVE FOR MULTICOLOR IMAGE FORMING APPARATUS, there is disclosed an electrophotographic apparatus of the above type in which the transfer and photoconductive drums are slightly spaced apart. The photoconductive drum is continuously driven by a precision stepper motor, and the transfer drum is independently driven by a worm gear drive. During transfer, when the transfer drum is rotatably driven by the photoconductive drum through the receiver sheet, the worm gear drive is overriden, assuring that it does not interfere with the advancement of the transfer drum by the other drum. Here, again, re-indexing of the transfer drum is achieved during the interframe period by using the worm gear drive motor to accelerate the transfer drum at the proper time and to the appropriate speed to achieve image registration at the transfer zone (i.e., the nip between the drums). As in the above systems, two precision motors are used, one for each drum.

SUMMARY OF THE INVENTION

In view of the foregoing discussion, an object of this invention is to obviate the need for two precision drive motors in an image recording apparatus of the above type.

In one aspect, the present invention represents an improvement over the invention disclosed in the above-referenced Jamzadeh et al. and Johnson applications in that it makes use of the concept of driving the transfer drum via the frictional engagement between the receiver sheet and the process drum during image transfer, and of re-indexing the position of the receiver sheet between successive image transfers. But, rather than using two precision drive motors to implement this concept, the present invention achieves the same objects with but a single precision drive motor.

Like the prior art apparatus discussed above, a preferred embodiment of the recording apparatus of the invention comprises:

(a) a rotatably supported process drum having an outer surface on which transferable toner images can be formed;

(b) drive means for rotating the process drum about its longitudinal axis at a predetermined angular velocity;

(c) imaging means for producing transferable toner images on the outer surface of the process drum as the drum rotates; and (d) a rotatably supported transfer drum having an outer surface adapted to receive and transport an image receiver sheet onto which transferable images formed on the outer surface of the process drum are to be transferred, such transfer drum being supported for rotation about its longitudinal axis and being located such that the transfer drum is frictionally rotatably driven by the process drum whenever a receiver sheet is positioned in the nip between the drums.

Unlike the prior art apparatus, however, the apparatus of the invention is characterized by:

(e) linking means operatively connecting the transfer drum and the drive means for enabling the transfer drum to be driven directly by the drive means whenever the transfer drum is not being frictionally driven by the process drum, such linking means being adjustable to control the instantaneous angular position of the transfer drum relative to the instantaneous angular position of the process drum while the transfer drum is being driven directly by the drive means; and (f) means for adjusting the linking means to control the angular position of the transfer drum relative to the process drum while the transfer drum is being driven directly by the drive means so that the transferable images arrive at the transfer nip in registration with a desired portion of the receiver sheet.

According to a preferred embodiment, the above-mentioned linking means comprises four rotatably mounted and intermeshing gears, two of such gears being rigidly connected to and mounted for rotation with the process and transfer drums. The other two gears are idler gears which provide a linkage between the first two gears, allowing the transfer drum to be driven directly by the drive means when no receiver sheet is positioned in the transfer nip, yet allowing the transfer drum to be frictionally driven by the process drum whenever a receiver sheet is positioned in the transfer nip. The idler gears are mounted for planetary movement about each other, and their relative position, which is set prior to each image transfer by the adjusting means, controls the relative angular positions of the process and transfer drums.

To assure precise registration between the receiver sheet and the transferable toner image at the nip between the drums, means are provided for sensing the displacement of each toner image from a nominal position and/or the displacement of the receiver sheet from a nominal position on the transfer drum. A control signal representing such displacements is used to control the adjusting means to appropriately re-adjust the instantaneous angular position of the transfer drum prior to image transfer.

By virtue of the invention, both drums can be rotated by a single precision drive motor, and a relatively low cost transducer can be used to fine tune the instantaneous angular relationship between the two drums in order to achieve image registration and placement on the receiver sheet.

The invention and its advantages will be better understood from the ensuing detailed description of preferred embodiments, reference being made to the accompanying drawings.

BEST MODE FOR CARRYING OUT THE INVENTION

Figure 1:
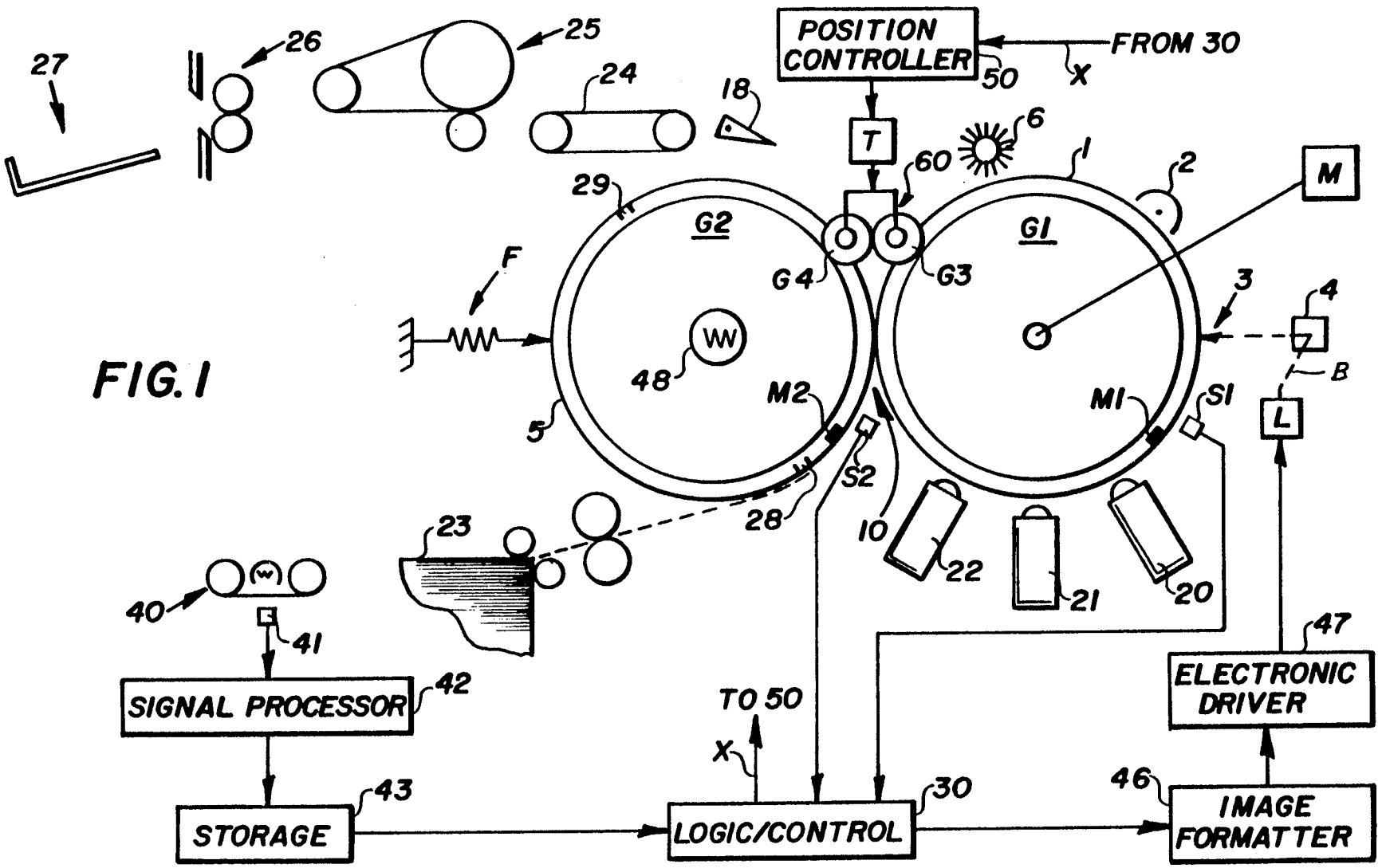
FIG. 1 is a schematic side elevation of an electrophotographic color image-forming apparatus embodying the present invention.

Referring to the drawings, FIG. 1 is a schematic illustration of an electrophotographic color printer embodying the invention. Most of the apparatus shown is conventional, as is its operation. The image recording element, for example, comprises a photoconductive drum 1 which is rotated at a constant angular velocity in a clockwise direction by a stepper motor M. Positioned about the drum periphery are the various processing stations which act collectively to carry out the well-known electrophotographic image-forming process. A corona charging station 2 functions to uniformly charge the the photoconductive surface of the process drum. This uniformly charged surface is then imagewise exposed at an exposure station 3 to form a developable electrostatic charge pattern. The exposure station may comprise, for example, a laser diode L whose output beam B is intensity modulated with image information to be recorded. Beam B is repeatedly scanned across the width of the process drum, parallel to the drum's axis of rotation, by a rotating polygon 4 to selectively dissipate the uniform charge and thereby form the developable charge pattern. In a full color recording system, a series of color separation images are sequentially formed in this manner, and each image is rendered visible as it passes one of a plurality of development stations 20, 21 and 22 which applies a suitably colored toner to the charge image. The toner images so produced are then transferred, seriatim and in registration, to a receiver sheet S carried on the surface of a rotatably driven transfer drum 5. Such transfer is effected at an image transfer station 10 defined by the nip region between the process and transfer drums. After image transfer, the process drum is cleaned of residual toner by a cleaning station 6 and recycled through the image-forming process.

The image receiver sheets are fed from a sheet supply 23 toward the outer surface of the transfer drum. As each sheet approaches the transfer drum, it is secured to the transfer drum by gripping fingers or, as illustrated, by a series of vacuum ports 28 and 29 which secure the leading and trailing edges of the sheet to the drum surface. Rotation of the transfer drum operates to advance the receiver sheet through the image-transfer station where the receiver sheet receives the developed toner images from the process drum. Assuming the process drum bears three color separation toner images (e.g., cyan, yellow and magenta), the transfer drum makes three revolutions through the transfer station so that the receiver sheet receives the three images, one atop the other. Following transfer of the three images, the receiver sheet is stripped from the transfer drum by a stripping mechanism 18. The receiver sheet is then pushed by further rotation of the transfer drum onto a sheet transport 24 which transports it to a toner fixing device 25 and then to a cutter 26. After the sheet has been cut to desired sizes, the resulting prints are deposited in a tray 27.

The input for the exposure station 3 may be provided by a color scanner 40 which typically includes a color-responsive charge coupled device (CCD) 41 for scanning an original to be printed, for example, a 35 mm color negative film. The CCD output is fed to a signal processor 42 which converts it to a form suitable for storage in a memory 43. the signal processor can also be used to enhance the image, as is well known.

A logic and control unit (LCU) 30 serves to access the images stored in memory 43 and manage the timing of the entire apparatus. The LCU may also be responsive to a print format designation signal supplied by an operator control panel (not shown) which would supply that information in an appropriate form to an image formatter 46 which, in turn, would provide the bit map for the ultimate exposure. The output of the image formatter controls an electronic driver 47 which, in turn, controls the laser power of the laser scanner.

According to one aspect of this invention, transfer drum 5 is continuously driven by the process drum stepper motor M via a gear train 60 (composed of gears G1–G4) in order to present the leading edge of an attached receiver sheet to the image-transfer nip between the two drums. The drums are very closely spaced apart (nominally, by the compacted thickness of the receiver sheet) so that, after the receiver sheet enters the transfer nip, the transfer drum is advanced by the frictional contact between the process drum and the receiver sheet. During the period of image transfer while the receiver sheet is interposed between the two drums, the gear train drive is overridden (as explained later herein) by the driving force applied by the process drum.

According to another aspect of this invention, the relative instantaneous angular positions of the process and transfer drums are adjusted before each image transfer to control the registration of the transferred image on the receiver sheet. This adjustment is made "on the fly", i.e., while both drums rotate, in contrast with prior art systems that momentarily stop one drum (usually the transfer drum) and then accelerate the stopped drum to achieve image registration at the transfer station. According to a preferred embodiment, the instantaneous angular position of the transfer drum is adjusted relative to that of the process drum by a position-control mechanism 50. The latter responds to a position-control signal produced by the LCU indicating the position of the toner image on the process drum relative to the position of the receiver sheet on the transfer drum. As explained below, the position control mechanism acts, via a transducer T, to shift the angular position of the transfer drum by altering the relative positions of the individual gears comprising gear train 60. How this shift in position is accomplished is discussed below, following the description of the manner in which the aforementioned position-control signal is produced.

The approximate location of each toner image along the circumference of the photoconductive drum is controlled by the LCU. More specifically, a reflective mark M1 on the drum perimeter is detected by a photoelectric sensor S1 which provides a control signal to the LCU indicating that portion of the process drum which is to receive an image is approaching the exposure station. After a nominal time interval has elapsed following receipt of such control signal, the LCU directs the laser scanner to start the image exposure. Since the scanner usually operates asynchronously with the movement of the drum, a reflective facet of the rotating polygon 4 is usually not in a position to start a scan line at the precise instant that the LCU directs that printing should begin. Whenever the polygon must be further rotated to properly position one of its facets to start a new scan line following the LCU's print command, there will be a slight delay in the start of the image formation. This delay translates into a slight displacement error (e.g., by up to 0.005 cm.) of the position of the charge image relative to a nominal position along the perimeter of the process drum. The LCU keeps track of the length of this delay for each image formed and uses this information in producing a control signal x which is used (in the manner described below) to adjust the rotational position of the transfer drum 5 prior to image transfer in order to achieve precise image registration. Such adjustment assures precise image registration with a desired portion of the transfer drum surface, for example, that portion that carries a receiver sheet with a previously transferred image thereon.

In addition to the above-mentioned small displacement error of the transferable image on drum 1, it is likely that the position of the receiver sheet on the transfer drum will deviate, from print to print, from a nominal position. Unless compensated for, this error, too, will give rise to image placement errors. Also, when attempting to print an image over the entire surface of the receiver sheet, from leading edge to trailing edge, or, alternatively, to provide uniform blank margins on the ultimate print, it is necessary to know with precision, the position of the receiver sheet on the transfer drum. To provide this information, a mark M2 is provided on the perimeter of the transfer drum. Such mark is detected by a photoelectric sensor S2 which provides an output signal when mark M2 passes thereunder, as well as a signal when the leading edge of the receiver sheet passes by. The elapsed time between these two signals is compared, by the LCU, with a nominal time interval representing the nominal position of the sheet on the transfer drum relative to mark M2. As in the above case, this measured time interval is used by the LCU in developing the control signal x which is used to adjust the positional relationship between the two drums at the time of image transfer. The specifics of image transfer and registration are discussed below.

Figure 2A:
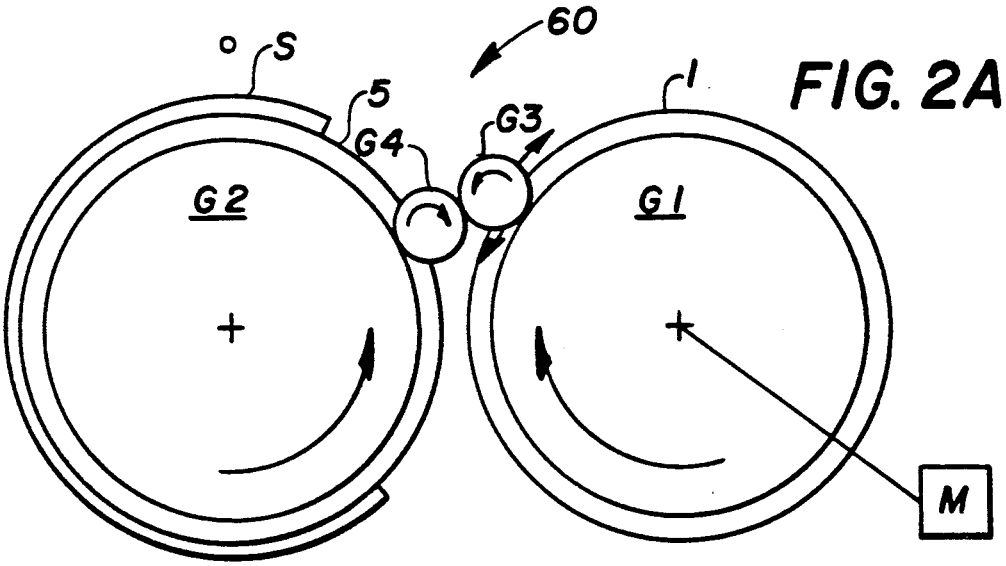
FIGS. 2A–2C illustrate the movement of the gear coupling between the process and transfer drums of the FIG. 1 apparatus.
Figure 2B:
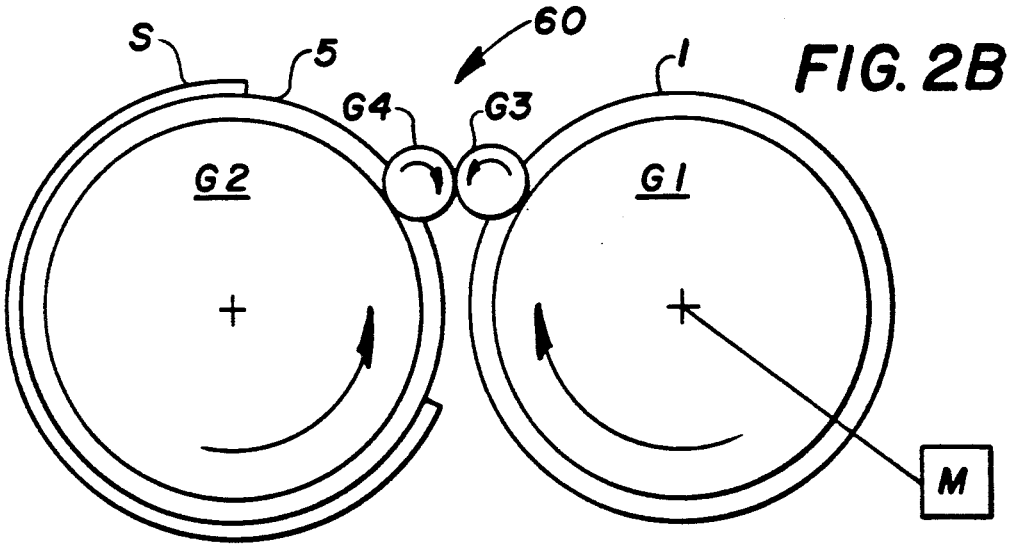
Figure 2C:
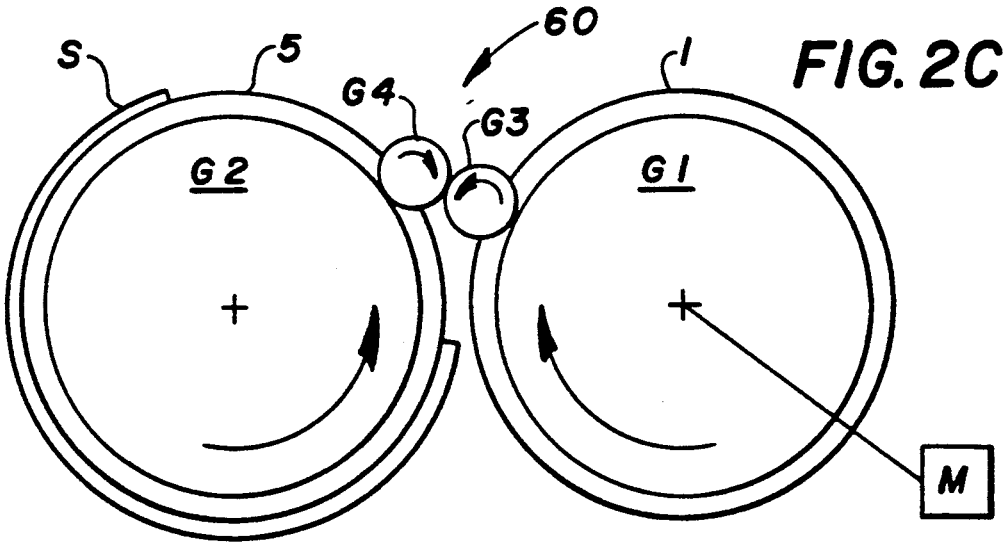

Referring to FIGS. 2A–2C, a portion of the mechanism for assuring precise registration of successively transferred toner images comprises gear train 60 which operatively couples the transfer drum with the process drum drive motor M. In accordance with a preferred embodiment of the invention, such gear train comprises four gears G1–G4. Gears G1 and G2 are rigidly connected to the process and transfer drums, respectively, and rotate therewith. Gears G3 and G4 are idler gears which interconnect gears G1 and G2. As illustrated, idler gear G3 is movably mounted so as to undergo planetary movement about process drum gear G1 and idler gear G4. Similarly, idler gear G4 is movably mounted for planetary movement about transfer drum gear G2 and idler gear G3. It will be appreciated that by driving gear G1 in a clockwise direction, as shown, idler gear G3 will be rotated in a counter-clockwise direction. This, in turn, causes idler gear G4 to rotate clockwise which, in turn, causes transfer drum gear G2 to rotate counter-clockwise. Thus, it will be appreciated that drive motor M rotatably drives both drums. To control the instantaneous angular position or phase of the transfer drum relative to the process (as is necessary to compensate for the above-mentioned displacement errors) the relative positions of gears 3 and 4 are adjusted, for example from the position shown in FIG. 2A, to the positions shown in FIGS. 2B and 2C.

Referring to FIG. 2A, the manner in which gear train 60 operates to control image placement and registration may be best understood by assuming that the process gear G1 is stationary. When a downward force is exerted on the axel of idler gear G3, the latter begins to move downward along the perimeter of process drum gear G1, e.g., to the position shown in FIG. 2B. Owing to the engagement of the respective teeth of gears G1 and G3, gear G3 rotates counter-clockwise during such downward movement. The counter-clockwise rotation of gear G3 causes idler gear G4 to rotate clockwise and thereby move upwards along the perimeter of transfer gear G2. The clockwise rotation of idler gear G4 acts to rotate the transfer drum gear counter-clockwise, thereby advancing the angular position of the transfer drum relative to the process drum, causing the leading edge of the receiver sheet to enter the transfer nip earlier in time than would be the case had the initial downward force not been applied to gear G3. Thus, it is apparent that, by controlling the downward force on gear G3 and, hence, its position vis-a-vis gear gear G4, it is possible to control the position of the receiver sheet at the transfer nip and, hence, image registration and placement. The fact that all gears are intermeshed and are being rotatably driven at the time the adjustment force is applied has no effect on the adjustment in angular position of the transfer drum.

It will be appreciated that, in a multicolor printer, the greatest adjustment to the transfer drum position will be made prior to the first in a series of sequential color separated image transfers. Such adjustment will compensate for the relatively large error in positioning the receiver sheet on the transfer drum, as well as the smaller error in the placement of the toner image on the process drum. After the first image transfer, only the smaller error need be compensated for in order to provide registration of the remaining color separated images. Between successive prints of full color images, the linkage gears G3 and G4 return to their nominal position under the influence of a spring bias force, as explained below.

Figure 3A:
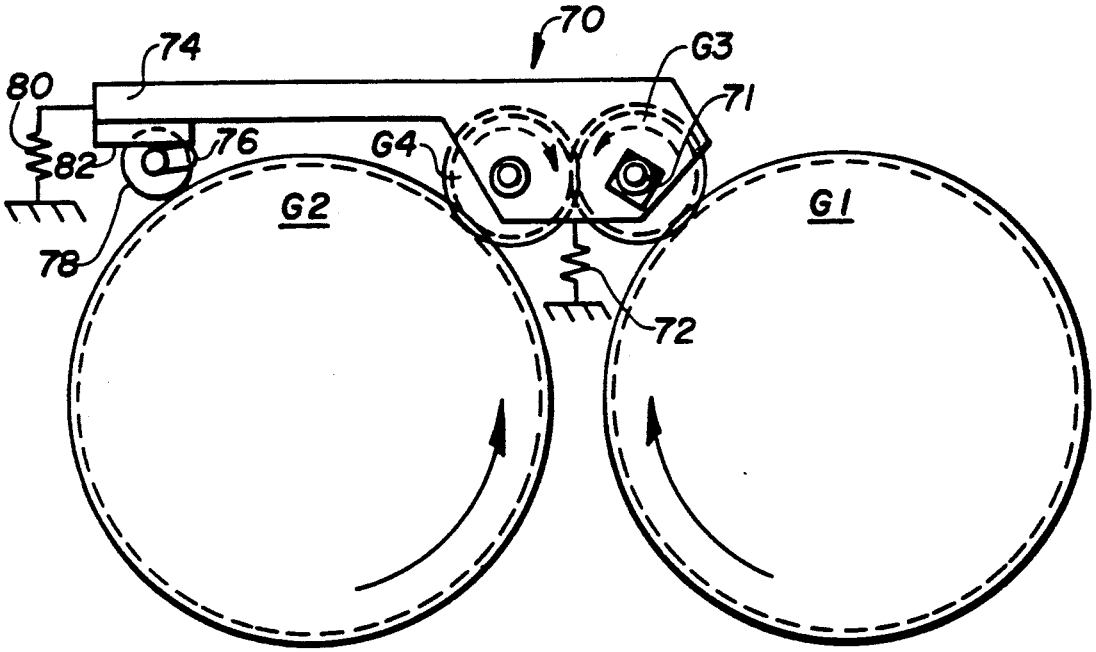
FIGS. 3A and 3B illustrate a preferred mechanism for supporting the gear coupling illustrated in the FIG. 1 apparatus.
Figure 3B:
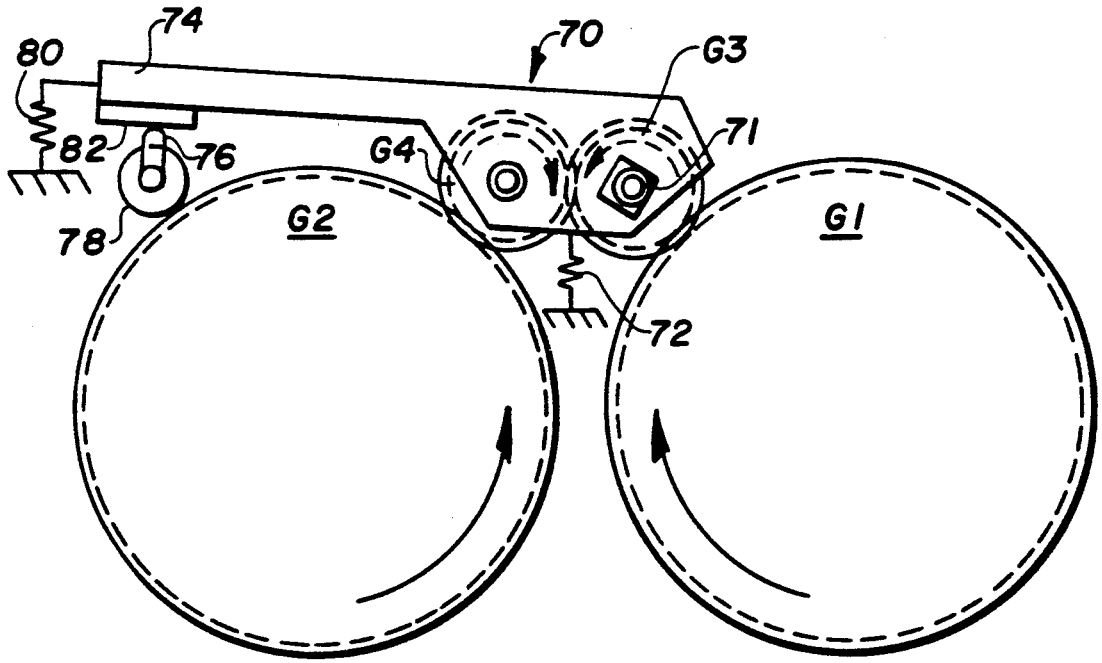

In FIGS. 3A and 3B, apparatus is shown for adjusting the relative positions of gears G3 and G4 in order to achieve image registration. Such apparatus comprises a yolk 70 which rotatably supports gears G3 and G4 so that their respective teeth intermesh with each other. While gear G4 is rotatably mounted at a fixed position in the yolk housing, gear G3 is given a small amount of freedom to move within a slot defined by a rectangular aperture 71 formed in each of the respective legs of the yolk. The freedom of movement provided be aperture 71 enables gears G3 and G4 to be spring loaded toward engagement with each other and thereby eliminate backlash. Yolk 70 is positioned to allow the teeth of gear G3 to mesh with those of the process drum gear G1, and to allow the teeth of gear G4 to mesh with those of the transfer drum gear G2. Spring means 72 urge the yoke downward, as viewed in the drawing, so that the respective teeth of the idler gears G3 and G4 always maintain engagement with drum gears G1 and G2 as these gears rotate and the adjustments are made in the relative positions of the idler gears. An elongated arm 74 extending from the yolk housing rests upon a rotatable cam member 76. The angular position of the cam member is controlled by a small motor 78 which responds to the output of position controller 50 to rotate cam member 76. Spring means 80 functions to urge arm 74 into contact with the cam member. A low-friction bearing surface 82 (e.g. Teflon) allows the arm portion of yolk 70 to slide on the surface of the cam member as the latter rotates.

In operation, motor 78 responds to a position control signal provided by the position controller 50, to rotate cam member 78 through a certain angular range. Such rotation has the effect of raising or lowering the arm 74 by a predetermined and calibrated amount. Assume, for example, the arm is raised to the position shown in FIG. 3B. This has the effect of causing gear G4 to move upwardly, in a counter-clockwise planetary motion about gear G2, and of simultaneously causing gear G3 to move downwardly, in a counter-clockwise planetary motion about gear G1. Note, too, that gears G3 and G4 also move in a planetary fashion about each other. In moving downwardly, the axel of gear G3 is acted upon by the top edge of aperture 71, under the force exerted by spring means 72. By making the diameter of the transfer drum slightly smaller than that of the process drum, the transfer drum will rotate slightly faster than the process drum. Thus, during image transfer when the transfer drum is being frictionally rotated by the process drum through the receiver sheet, the driving force provided by the gear train will be overridden by the frictional driving force provided by the surface of the process drum, causing gear G4 to move upwardly along the perimeter of Gear G2, and causing gear G3 to move downwardly along the perimeter of gear G1. Note, as gear G3 moves downwards, it moves away from the control surface provided by the upper edge of aperture 71. As gear G4 moves planetary about gear G2, yolk arm 74 slides slightly to the left and rotates slightly about the cam member 76. After transfer is completed and the receiver sheet is stripped from the transfer roll, the idler gears are returned to their nominal positions, as shown in FIG. 3A, by the forces exerted by springs 72 and 80. It will be appreciated that, by rotating cam member 76 in a clockwise direction from its position shown in FIG. 3A, the lever arm 74 is lowered, causing the reverse planetary movements of the idler gears, and a retardation of the transfer drum's angular position vis-a-vis the process drum.

To provide color prints of photographic quality, it is desirable to develop the electrostatic images on drum 1 with relatively fine (less than about 3.5 microns in diameter) toner particles. Since such particles are difficult to transfer electrostatically, it is desirable to effect transfer by a combination of heat and pressure. Thus, as schematically illustrated, drum 5 is internally heated by a resistance heater 48 to provide a surface temperature of about 110 degrees C., and a force F is applied to produce a nip pressure of at least about 30 pounds per linear inch. In addition to heating the transfer drum, the process drum may also be heated, albeit to a lesser temperature of up to about 40 degrees C. Note, since it is undesirable to produce physical contact between the respective drum surfaces, spacer means may be provided to maintain a spacing of approximately the compacted thickness of a receiver sheet, i.e., about 0.0175 cm. Such a spacing allows the transfer drum to be frictionally driven by the process drum during while a receiver sheet is positioned in the transfer nip, yet prevents the transfer drum from abrading the photoconductive layer during periods of non-transfer. The drum spacer means may take the form of two rigid bars located on opposite sides of the drums and extending between the respective bearings of the drums. The spacer bars are preferably made of a metal having a very low coefficient of thermal expansion, such as Invar.

Preferably, the transfer drum is selectively movable (e.g., by about 0.035 cm.) toward and away from the process drum to provide, for example, a means for facilitating the clearing of paper jams, or to allow the drums to be moved into a transfer position (i.e., close together) only after the leading edge of the receiver sheet has entered the transfer nip. Such an articulated movement of the transfer drum is useful in avoiding so-called torque spikes which occur when the leading edge of the receiver sheet enters the transfer nip. These torque spikes can give rise to an uncompensatable displacement of the process drum relative to the scanning laser at the exposure station. By using a cam mechanism or the like to space the drums until the leading edge of the receiver sheet has entered the transfer nip and then to close the drum spacing to pinch the sheet between the drums, the adverse effects of such torque spikes are minimized.

The invention has been described in detail with particular reference to certain preferred embodiments. It will be understood, however, that variations and modifications can be made without departing from the spirit and scope of the invention, as defined by the following claims.

What is claimed is:

1. A recording apparatus for recording image information on image receiver sheets having a nominal thickness, said apparatus comprising:

(a) a rotatably supported process drum having an outer surface on which transferable images can be formed;

(b) drive means for rotating said process drum about its longitudinal axis at a predetermined angular velocity;

(c) means for producing transferable images on the outer surface of said process drum;

(d) a rotatably supported transfer drum having an outer surface adapted to receive and transport an image receiver sheet onto which transferable images formed on the outer surface of said process drum are to be transferred, said transfer drum being supported for rotation about its longitudinal axis and being located such that said transfer drum is frictionally engaged and rotatably driven by said process drum whenever a receiver sheet is positioned in a nip region between said drums where transfer of the transferable images from the outer surface of said process drum to the receiver sheet is effected;

(e) linking means operatively connecting said transfer drum and said drive means for enabling said transfer drum to be rotatably driven directly by said drive means whenever said transfer drum is not being frictionally driven by said process drum, said linking means being adjustable to control the instantaneous angular relationship between said drums while said transfer drum is being rotatably driven directly by said drive means, said linking means comprising four rotatably mounted and intermeshing gears, two of said gears being rigidly connected to and mounted for rotation with said process and transfer drums, respectively, and the other two gears providing an overridable coupling between said first two gears which enables said transfer drum to be driven directly by said drive means, yet enables said transfer drum to be frictionally driven by said process drum through the receiver sheet without substantial impedance by said gears, said overridable coupling being provided by means for rotatably supporting said other two gears for planetary motion about each other, the relative position of said other two gears determining the relative instantaneous angular relationship between said process and transfer drums; and (f) means for adjusting said linking means to control said instantaneous angular relationship while said transfer drum is being driven directly by said drive means so that transferable images on the outer surface of said process drum arrive at said nip region in timed relation with the arrival of a desired portion of the receiver sheet.

2. The apparatus as defined by claim 1 further comprising:

means for sensing the position of the transferable image formed on said process drum relative to a nominal position and for producing a control signal representing the displacement of such image relative to such nominal position, said adjusting means being responsive to said control signal to appropriately adjust said linking means so that the transferable images are transferred to a desired portion of the receiver sheet.

3. The apparatus as defined by claim 1 further comprising:

means for sensing the position of a receiver sheet on said transfer drum relative to a nominal position and for producing a control signal representing the displacement of such sheet from such nominal position, said adjusting means being responsive to said control signal to adjust said linking means so that the transferable images are transferred to a desired portion of the receiver sheet.

4. The apparatus as defined by claim 1 further comprising:

means for sensing the position of the transferable images formed on said process drum relative to a nominal position and for producing a first control signal representing the displacement of such images relative to such nominal position; and means for sensing the position of a receiver sheet on said transfer drum relative to a nominal position and for producing a second control signal representing the displacement of such sheet from such nominal position, said adjusting means being responsive to said first and second control signals to adjust said linking means so that the transferable images are transferred to a desired portion of the receiver sheet.

5. The apparatus as defined by claim 1 wherein said adjusting means is responsive to a control signal to adjust the relative instantaneous positions of said other two gears.

6. The apparatus as defined by claim 5 wherein said control signal is indicative of the position of a toner image on the outer surface of the process drum relative to a nominal position.

7. The apparatus as defined by claim 5 wherein said control signal is indicative of the position of a receiver sheet on the outer surface of said transfer drum relative to a nominal position.

8. The apparatus as defined by claim 5 wherein said control signal is indicative of both the position of a toner image on said process drum relative to a nominal position, and the position of a receiver sheet on said transfer drum relative to a nominal position.

9. In an apparatus for producing a toner image on a receiver sheet by first forming a toner image on the outer surface of a rotating process drum and transferring such image to a receiver sheet carried on the outer surface of a rotating transfer drum, apparatus for controlling the placement of the transferred image on the receiver sheet, said placement-controlling apparatus comprising:

means for determining the positional relationship between a toner image on the surface of the process drum and a receiver sheet on the surface of the transfer drum and for producing a control signal indicative of such relationship; and means responsive to said control signal for adjusting the instantaneous angular relationship between said drums while said drums rotate to assure that the toner image on the process drum is transferred to a desired portion of the receiver sheet, said adjusting means comprising an adjustable gear train including a plurality of rotatably mounted gears operatively coupling the process and transfer drums, and means for adjusting the planetary relationship between certain gears in said gear train to adjust said angular relationship between said drums.

10. The apparatus as defined by claim 9 wherein said process and transfer drums are rotatably driven by the same drive source.

11. Color printing apparatus for recording multicolor images on image receiver sheets having a nominal thickness, said apparatus comprising:

(a) a rotatably supported process drum having an outer surface on which transferable images of different color can be formed;

(b) drive means for rotating said process drum about its longitudinal axis at a predetermined angular velocity;

(c) means for producing a series of different color images on the outer surface of said process drum, each of such color images representing a color separation image of a multicolor image to be produced on an image receiver sheet;

(d) means for transferring such series of different color images to an image receiver sheet, said transferring means comprising a rotatably supported transfer drum having an outer surface adapted to receive and transport an image receiver sheet onto which such transferable images formed on the outer surface of said process drum are to be transferred in registration to produce such multicolor image, said transfer drum being supported for rotation about its longitudinal axis and being located such that said transfer drum is frictionally engaged and rotatably driven by said process drum whenever a receiver sheet is positioned in a nip region between said drums where transfer of the transferable color images from the outer surface of said process drum to the receiver sheet is effected;

(e) linking means operatively connecting said transfer drum and said drive means for enabling said transfer drum to be rotatably driven directly by said drive means whenever said transfer drum is not being frictionally driven by said process drum, said linking means being adjustable to control the instantaneous angular relationship between said drums while said transfer drum is being rotatably driven directly by said drive means, said linking means comprising four rotatably mounted and intermeshing gears, two of said gears being rigidly connected to and mounted for rotation with said process and transfer drums, respectively, and the other two gears providing an overridable coupling between said first two gears which enables said transfer drum to be driven directly by said drive means, yet enables said transfer drum to be frictionally driven by said process drum through the receiver sheet without substantial impedance by said gears, said overridable coupling being provided by means for rotatably supporting said other two gears for planetary motion about each other, the relative position of said other two gears determining the relative instantaneous angular relationship between said process and transfer drums.

12. The apparatus as defined by claim 11 further comprising:

means for sensing the position of each of the series of transferable images formed on said process drum relative to a nominal position and for producing a first control signal representing the displacement of such images relative to such nominal position; and means for sensing the position of a receiver sheet on said transfer drum relative to a nominal position and for producing a second control signal representing the displacement of such sheet from such nominal position, said adjusting means being responsive to said first and second control signals to adjust said linking means so that the transferable images are transferred in registration to a desired portion of the receiver sheet.

13. The apparatus as defined by claim 11 wherein said adjusting means is responsive to a control signal to adjust the relative instantaneous positions of said other two gears.

14. In an apparatus for producing a multicolor toner image on a receiver sheet by first forming a series of different color separation toner images on the outer surface of a rotating process drum and transferring such images in registration to a receiver sheet carried on the outer surface of a rotating transfer drum, apparatus for controlling the registration of the transferred images on the receiver sheet, said registration-controlling apparatus comprising:

means for determining the positional relationship between each of the color separation toner images on the surface of the process drum and a receiver sheet on the surface of the transfer drum and for producing a control signal indicative of such relationship; and means responsive to said control signal for adjusting the instantaneous angular relationship between said drums while said drums rotate to assure that the toner images on the process drum are transferred in registration to a desired portion of the receiver sheet, said adjusting means comprising an adjustable gear train including a plurality of rotatably mounted gears operatively coupling the process and transfer drums, and means for adjusting the planetary positional relationship between certain gears in said gear train to adjust said angular relationship between said drums.

15. The apparatus as defined by claim 14 wherein said process and transfer drums are rotatably driven by the same drive source.

* * * * *